United States Patent [19]

Visco

[11] 3,987,542

[45] Oct. 26, 1976

[54] SCISSORS

[76] Inventor: Luigi P. Visco, 4 Paugussett Road, Sandy Hook, Conn. 06482

[22] Filed: Aug. 22, 1975

[21] Appl. No.: 606,834

[52] U.S. Cl. ..... 30/233; 30/257

[51] Int. Cl.[2] ..... B26B 13/08; B26B 29/04

[58] Field of Search ..... 30/254, 257, 233; 7/1 H; 76/104 A

[56] References Cited

UNITED STATES PATENTS

| | | | |
|---|---|---|---|
| 192,426 | 6/1877 | Foltz | 30/257 X |
| 342,380 | 5/1886 | Orahood | 30/257 |
| 643,539 | 2/1900 | Rowe | 30/266 X |
| 1,990,694 | 2/1935 | Jacobs | 76/104 A |
| 2,434,550 | 1/1948 | Daniel | 7/1 H |
| 2,801,467 | 8/1957 | Casanovas | 30/254 |
| 3,869,792 | 3/1975 | Laurenti | 30/254 |

*Primary Examiner*—Al Lawrence Smith
*Assistant Examiner*—J. C. Peters
*Attorney, Agent, or Firm*—Thomas L. Tully

[57] ABSTRACT

Improved angular shear or scissors comprising two mated scissor elements, each of which comprises a blade section, a shank section and a handle section, said elements being pivotally-united at a position between said blade and shank sections whereby said blade sections cooperate to provide a cutting action when said handle sections are manipulated. The invention is characterized by each of said blade sections being relatively flat and being upwardly inclined at an angle of at least about 20° from its shank section and the lower blade preferably being longer than the upper blade and being provided with a relatively narrow tip which is pointed for piercing purposes.

6 Claims, 3 Drawing Figures

SCISSORS

The present invention is concerned with shears or scissors which are designed primarily for the cutting of flat materials from a position and on a plane overlying said flat materials. For instance, it is difficult, if not impossible, to cut materials such as carpets, animal skins, sheet metal, or the like, with conventional shears or scissors on which the blade sections are straight continuations of the shank and handle sections. In such cases, unless the shears or scissors can be manipulated on the same plane as the material to be cut and unless the material is flexible, the cutting operation cannot be carried out.

Cutting shears or scissors having one or both blades inclined from the shank elements have been produced in the past. However such prior devices are unsatisfactory for the cutting of flat materials from a position and on a plane overlying said flat materials for one or more reasons. Some of the prior devices have only one inclined blade, the other blade being straight and requiring that the device be used on the same plane as the material being cut. Other prior devices, such as surgical shears, have projections at the tip of one or both blades so that the blades are not sufficiently thin or flat to permit piercing of the material to be cut and/or the projection interferes with the cutting of woven materials due to the snagging of the woven threads by the projection.

It is the principal object of the present invention to provide a new and improved shear or scissors adapted for piercing and cutting operation on a plane overlying a flat element being cut.

It is another object of this invention to provide a new and improved shear or scissors which enables the user to oversee the cut being made in the material being severed, thereby enabling the making of a straighter cut.

It is yet another object of this invention to provide a new and improved shear or scissors which perform their cutting operation at an angle relative to the direction of the shanks of the blades, thereby permitting sufficiently strong manual pressure to cut relatively thick metal such as a penny coin.

These and other objects and advantages of the present invention will be apparent to those skilled in the art in the light of the present disclosure including the drawing, in which.

Figure 2:
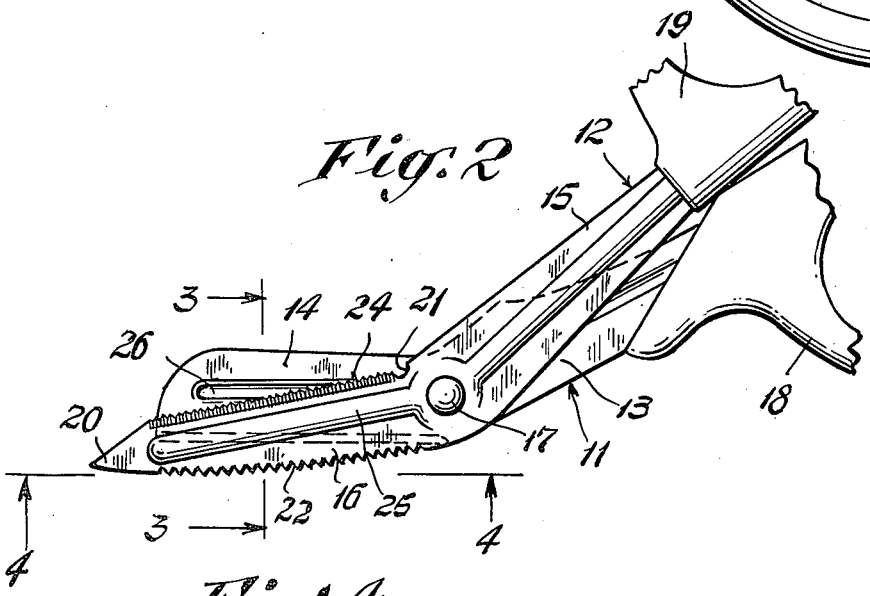
FIG. 2 is a segmented side view of the blade and shank sections of the shear or scissors of FIG. 1, the blades being shown in closed position.
Figure 3:
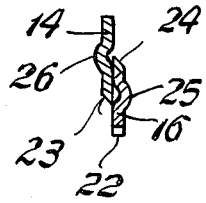
Figure 4:
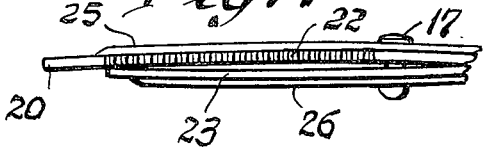

FIGS. 3 and 4 are cross-sectional views of blades 14 and 16 taken along the lines 3—3 of FIG. 2 and 4—4 of FIG. 2, respectively.

Figure 1:
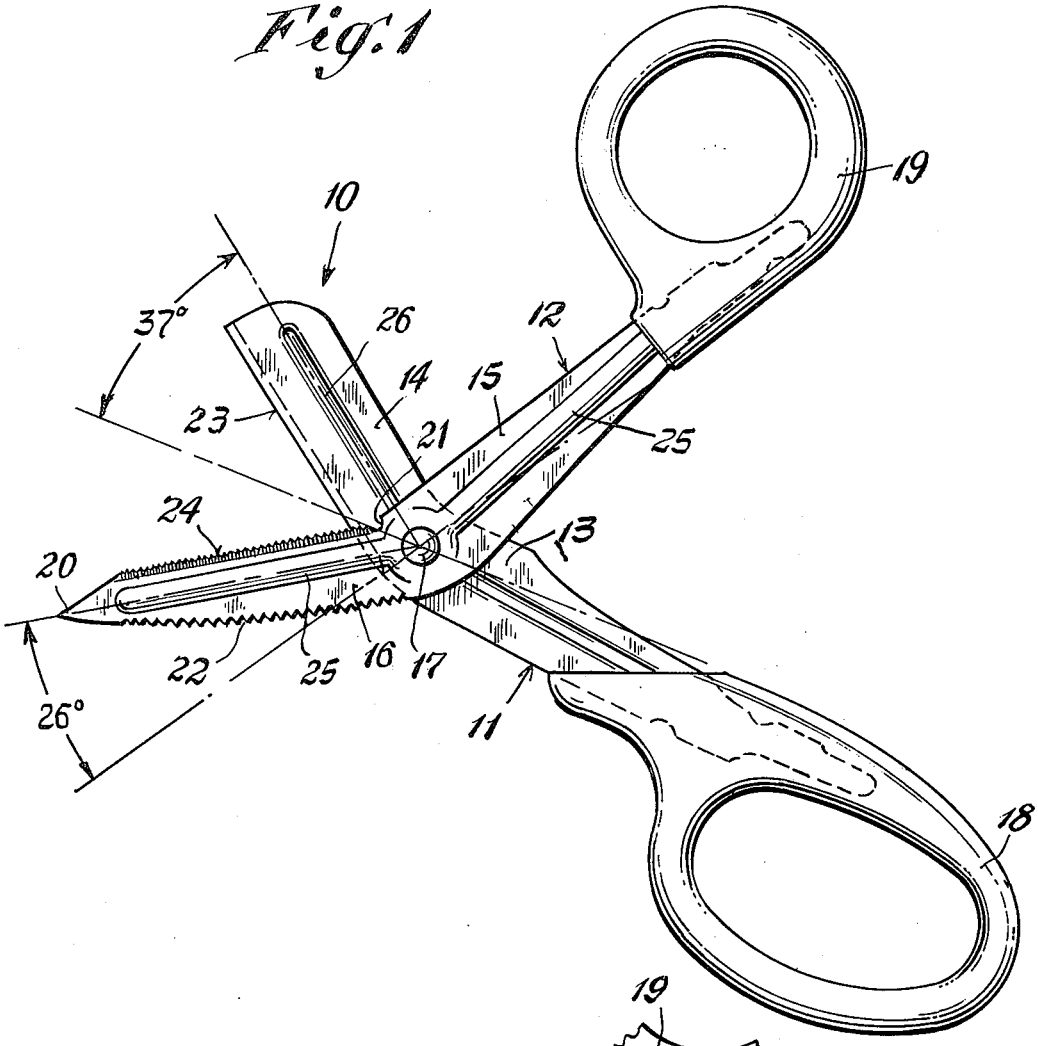
FIG. 1 is a side view of a shear or scissors according to one embodiment of the present invention, the blades being shown in partially-open position for purposes of illustration.

Referring to FIG. 1 of the drawing, the scissors 10 comprises two mated scissor elements 11 and 12 which are pivotally connected to each other at a position between the shank section 13 and blade section 14 of the upper element 11 and the shank section 15 and blade section 16 of the lower element 12 by means of a pin 17, the pin or pivot location delineating the juncture of the blade and shank sections of each of the scissor elements 11 and 12. In the embodiment illustrated, each of the sections 11 and 12 is provided with molded polypropylene plastic grips 18 and 19, respectively, which are injection-molded onto the elements during manufacture.

As shown more clearly in FIG. 2 of the drawing, the lower blade 16 is provided with a material-piercing point 20 which extends beyond the tip of the upper blade 14 so that the tip of the lower blade can be pierced through material to be cut, such as cardboard, animal skin, carpeting, or the like, while the blades are in closed position, thereby avoiding the possibility of cutting the hands or making a false cut in the material to be severed.

In the embodiment illustrated, the cutting edge of blade section 14 is inclined upwardly at an angle of about 37° from the direction of its shank section 13 while the cutting edge of blade section 16 is inclined upwardly at an angle of about 26° from its shank section 15, the direction of each shank section being determined by a straight line drawn from the center of pin 17, i.e. the pivot point, and the point at which each of the handles 18 and 19 make contact with each other when the shear or scissors is closed, as illustrated.

The drawing also illustrates the optional presence of a wire cutting notch 21 at the start of the cutting edge on lower blade 16 and a fish-scaling teeth edge 22 on the underside of lower blade 16.

Referring to FIGS. 3 and 4, blades 14 and 16 are illustrated in closed overlapped position. Blade 14 has a sharp cutting edge 23 which is beveled downwardly and inwardly toward blade 16 while blade 16 has a sharp cutting edge 24 which is beveled upwardly and inwardly toward blade 14 so that the sharp edges come together during the cutting operation, the pin 17 holding the blades in relatively tight engagement with each other during the cutting operation.

The shear or scissors as illustrated constitutes a preferred embodiment from the standpoint of design and materials. The angle of the cutting edges of the blades, relative to the shanks of the blades, is between about 20° and 40°. The mating elements 11 and 12 are made of 0.062 inch thick stainless steel by a metal stamping and forming process and are provided with ribs 25 and 26 for additional strength, as illustrated.

The plastic handles 18 and 19 are injection-molded onto shank sections 13 and 15 respectively and are rounded for comfort and ease of operation. Contoured molded plastic handles may also be used as may unitary metallic handles which are extensions of the shank sections.

In the preferred embodiment shown in the drawing, the cutting edge 24 of the lower blade 16 is a finely serrated edge while the cutting edge 23 of the upper blade 14 is a standard smooth beveled edge. However, as is apparent to those skilled in the art, shears or scissors for different purposes will have different cutting edges including different combinations of the aforementioned cutting edges as well as pinking shear edges, thinning shear edges, and the like. Most common are the serrated and smooth beveled edges and combinations thereof. For instance, both blades may have serrated edges, or both may have smooth beveled edges, or either blade may be serrated while the other is smooth beveled.

The piercing tip 20 has a relatively sharp point, the shape and degree of sharpness of the point depending upon the end use to which the shears or scissors are to be put. Shears for piercing tough animal skin, cardboard or plastic will require sharper piercing points than shears for piercing carpeting, woven fabrics and other softer materials. In all cases, however, the piercing point extends beyond the end of the upper blade to permit piercing when the blades are in closed position, and preferably the shorter upper blade has a blunt, rounded tip, as illustrated, which provides a stop element against excessive penetration of the lower blade into the material during the puncturing step, thereby avoiding false tears or cuts in undesired directions.

In all cases the piercing tip 20 is flat and thin and free of projections which would make the tip thicker than the metal stock from which the remainder of the blade 16 is formed, as illustrated by FIG. 4. This permits the tip of the shears or scissors to be inserted into narrow slots or spaces and to be withdrawn from narrow slits cut into rigid materials such as sheet metal, cardboard, or the like.

While the preferred angle of inclination of each of the blades 14 and 16 from the direction of their respective shank sections 15 and 13 is between about 20° and 40°, it should be understood that angles of inclination up to about 90° may be used for certain end uses where it is desirable to have a cutting action occur at substantially a right angle to the direction of the shank sections.

Variations and modifications may be made within the scope of the claims and portions of the improvements may be used without others.

I claim:

1. An angular cutting scissors comprising two mated scissor elements each of which comprises a blade section having a cutting edge, a shank section and a handle section, said scissor elements being pivotally united at a point intermediate their blade and shank sections to cause the cutting edges of the blade sections to engage each other with a cutting action when said handle sections are moved into contact with each other, characterized by said blade sections being flat and free of projections or areas of increased thickness and having their cutting edges inclined from the direction of their respective shanks at an angle of at least about 20°, one of said blades being a lower blade which is adapted to extend beneath a material being cut, is longer than the other or upper blade, and is provided with a pointed piercing tip, and said other or upper blade having its cutting edge inclined at an angle greater than the angle of inclination of the cutting edge of said lower blade and having a blunt tip which extends above the piercing tip of the lower blade when the blades are in closed position to provide a stop element which limits the extent of penetration of the lower blade into a material being pierced, the angle of inclination of each of said cutting edges being determined relative to a straight line drawn from the point at which the handle sections make contact with each other through the pivot point at which said blades are united.

2. An angular cutting scissors according to claim 1 in which the cutting edge of either or both blade sections is selected from the group consisting of serrated edges, smooth beveled edges, pinking edges and thinning edges.

3. An angular cutting scissors according to claim 1 in which the underside of the lower blade section, which extends beneath the material being cut, is provided with scaling teeth.

4. An angular cutting scissors according to claim 1 in which said handle sections comprise plastic handle sections which are molded onto said shank sections.

5. An angular cutting scissors according to claim 1 in which the blade element and shank element of each of said scissor elements comprise stainless steel which is provided with an impressed rib for increased strength.

6. An angular cutting scissors according to claim 1 in which each of said cutting edges is inclined at an angle of from about 20° to about 40°.

* * * * *